United States Patent [19]

Wakayama et al.

[11] Patent Number: 4,626,370

[45] Date of Patent: Dec. 2, 1986

[54] MAGNETIC FLUID

[75] Inventors: Katsuhiko Wakayama; Hiraku Harada, both of Tokyo, Japan

[73] Assignee: TDK Corporation, Tokyo, Japan

[21] Appl. No.: 775,356

[22] Filed: Sep. 12, 1985

[30] Foreign Application Priority Data

Sep. 17, 1984 [JP] Japan ..... 59-194322
Sep. 18, 1984 [JP] Japan ..... 59-194985

[51] Int. Cl.[4] ..... H01F 10/10

[52] U.S. Cl. ..... 252/62.52; 252/62.51; 252/62.53; 252/62.55

[58] Field of Search ..... 252/62.52, 62.51, 62.54, 252/62.55

[56] References Cited

U.S. PATENT DOCUMENTS 3,764,540 10/1973 Khalafalla et al. ..... 252/62.52
3,917,538 11/1975 Rosensweig ..... 252/62.52
4,315,827 2/1982 Bottenberg ..... 252/62.52
4,356,098 10/1982 Chagnon ..... 252/62.53
4,430,239 2/1984 Wyman ..... 252/62.52

OTHER PUBLICATIONS

Ito et al., Chem. Abstracts 87 (1977) #145014.
Winkler et al., Chem. Abstracts 86 (1977) #132462.
Mehta et al., J. Mag. and Mag. Mat. 39 (1983) pp. 35–38.
Merck Index 7th ed. (1960), pp. 1050, 1051, 1100.

*Primary Examiner*—Arthur P. Demers
*Attorney, Agent, or Firm*—Oblon, Fisher, Spivak, McClelland & Maier

[57] ABSTRACT

A magnetic fluid comprising metal fine particles of iron, 50 to 100 wt % of the metal particles of a surface-active agent selected from phospholipids, and 100 to 800 wt % of the metal particles of a medium in the form of a diester of an aliphatic dicarboxylic acid exhibits remarkably high saturation magnetization.

11 Claims, 2 Drawing Figures

MAGNETIC FLUID

BACKGROUND OF THE INVENTION

This invention relates to magnetic fluid.

Among magnetic fluids are known colloidal dispersions of fine particles of magnetic oxide material, typically magnetite ($Fe_3O_4$) pretreated with a surface-active agent in oil or water. Such magnetic fluids have been utilized in a variety of applications.

As is well know in the art, magnetic fluids often find applications as sealing materials for sealing of rotary shafts or the like. In these applications of magnetic fluids, it is often required that the mediums be low volatile, thermally stable and lubricant. Fatty acid mono- and di-esters as well as polyphenyl oil are well-known mediums which meet the above requirements. In fact these mediums have been used for producing magnetic fluids with magnetic oxide materials dispersed therein.

However, no attempt has been successfully made in producing magentic fluids meeting the above requirements by dispersing magnetic particles in the form of metal fine particles which themselves have high saturation magnetization. If magnetic fluids can be produced by dispersing a high concentration of metal fine particles in the above mentioned mediums, such magentic fluids which have increased saturation magnetization and superior thermal stability would find a wider variety of applications.

Metal fine particles in these magnetic fluids are expected to be oxidized with a probable reduction in saturation magnetization.

SUMMARY OF THE INVENTION

It is, therefore, an object of the present invention to provide a novel and improved magnetic fluid comprising metal fine particles of iron dispersed in a high-boiling medium and having an outstandingly higher saturation magnetization than prior art magnetic fluids. The magnetic fluid is produced at low cost since iron is a relatively cheap material which is readily available.

Another object of the present invention is to provide such a magnetic fluid characterized by controlled oxidation as well as increased saturation magnetization.

The present invention is directed to a magnetic fluid comprising metal fine particles of iron, a surface-active agent, and a medium. According to the present invention, the medium is at least one member selected from the group consisting of diesters of dicarboxylic acids.

In one preferred embodiment of the present invention, the magnetic fluid further contains an antioxidant for preventing oxidation of metal fine particles.

BRIEF DESCRIPTION OF THE DRAWINGS

The above and other objects, features, and advantages of the present invention will become more apparent by reading the following description taken in conjunction with the accompanying drawings, in which.

DETAILED DESCRIPTION OF THE INVENTION

Figure 1:
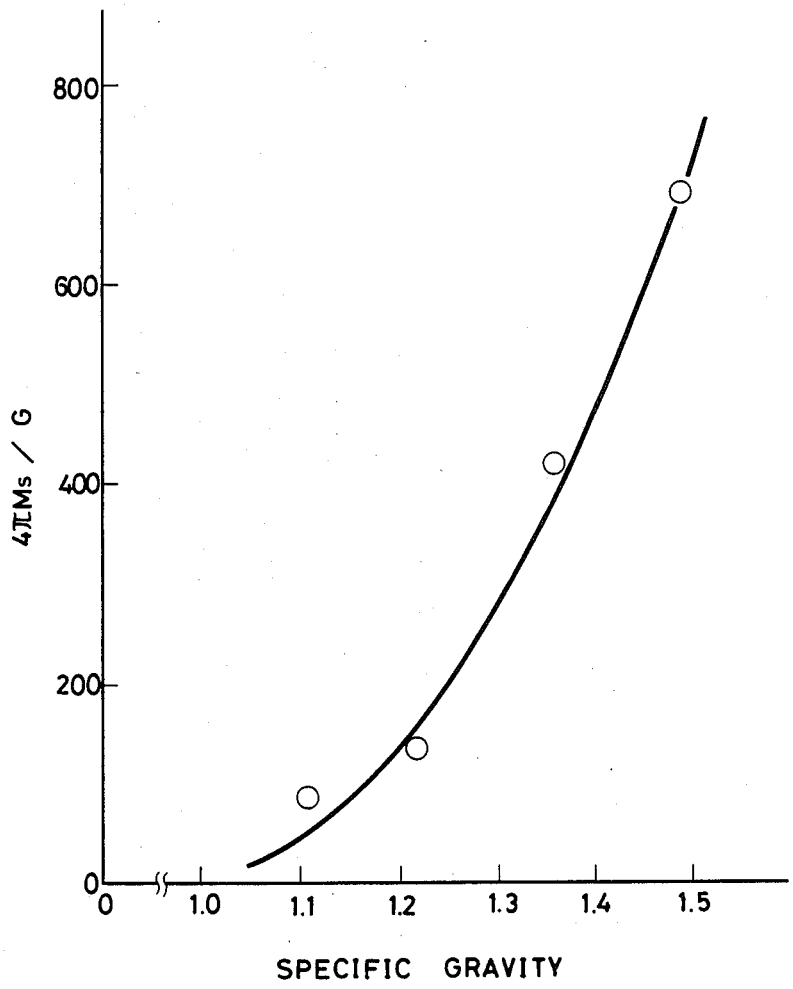
FIG. 1 is a diagram showing the saturation magnetization ($4\pi Ms/G$) of iron fine particle-containing magnetic fluids as a function of the specific gravity thereof, the magnetic fluid comprising dioctyl adipate as the high-boiling solvent and lecithin as the surface-active agent.

The present invention is directed to a magnetic fluid comprising metal fine particles of iron. Since ferromagnetic fine particles must be dispersed in liquid, iron metal must be first finely divided into discrete particles of a sufficient particle size to overcome their magnetic cohesive force. The iron metal fine particles used in the practice of the present invention have an average particle size of 70 to 100 Å.

The mediums used in the magnetic fluid according to the present invention should meet such properties as low-volatility, thermal stability and lubricity for practical uses. Diesters of dicarboxylic acids are thus selected as the solvent.

Preferred solvents are diesters of saturated aliphatic dicarboxylic acids having 6 to 10 carbon atoms alone or in admixture of two or more. These diesters are shown by the general formula [I].

$$ROOC(CH_2)_nCOOR \quad [I]$$

where n is an integer between 4 and 8. Among preferred saturated aliphatic dicarboxylic acids are adipic acid (n=4), azelaic acid (n=7) and sebacic acid (n=8). In formula [I], R represents a saturated aliphatic hydrocarbon group having 1 to 10 carbon atoms, and most preferably, 8 carbon atoms, namely, octyl groups including 2-ethylhexyl group.

The preferred diester solvents used in the practice of the invention are esters of the above-mentioned saturated aliphatic dicarboxylic acids with octyl alcohol, more specifically, 1-octanol or 2-ethylhexyl alcohol. Among such esters are di(2-ethylhexyl) adipate, di(2-ethylhexyl) azelate, and di(2-ethylhexyl) sebacate alone or mixtures of two or more. The dicarboxylic diester solvents are present in amounts of 100 to 800% by weight based on the weight of the metal fine particles.

It is necessary to prevent flocculation of fine particles due to van der Waals force. In the prior art, magnetic oxide particles are chemically coated with a polar surface-active agent to prevent flocculation by the repulsion of particles to each other. However, no such coating agent has been discovered for metal base magnetic fluids.

We have discovered that a phospholipid surface-active agent can effectively assist in the stable dispersion of metal fine particles.

More particularly, the phospholipid used as a surface-active agent in the present invention is lecithin either in the natural form as it is obained from soybeans or in the purified form thereof.

The lecithin has the general formula [II]:

Lecithin (phosphatidyl choline)

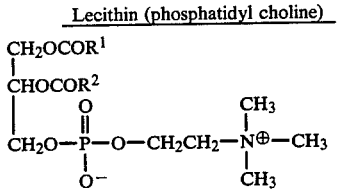

[II]

where $R^1$ and $R^2$ are individually selected from saturated or unsaturated fatty acids, and preferably those having up to about 20 carbon atoms, namely, palmitic acid, stearic acid, oleic acid, linolic acid and linolenic acid. $R^1$ and $R^2$ may be the same or different.

The surface-active agent is added to the fluid in amounts of 50 to 100% by weight based on the weight of the metal fine particles. Amounts of less than 50% by weight are ineffective in promoting dispersion. The metal fine particles will agglomerate and precipitate when the surface-active agent is present in excess of 100% by weight.

The lecithin used herein may be any desired commercially available product.

The magnetic fluids of the present invention may further contain an effective amount of an antioxidant for preventing oxidation of iron particles. The antioxidants used herein may be conventional oil-soluble antioxidants.

Tocopherols are preferred among others. The most preferred tocopherol is D,L-α-tocopherol having the general formula [III]:

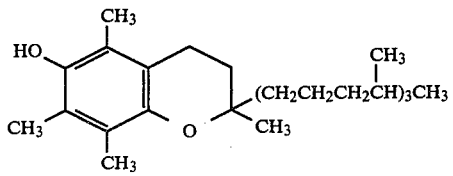

[III]

In addition, β-tocopherol, γ-tocopherol, δ-tocopherol, and d-α-tocopherol may also be used.

The antioxidants may be used in amounts of 0.8 to 10% by weight of the weight of the metal fine particles. Less than 0.8% of the antioxidant is ineffective whereas more than 10% of the antioxidant will adversely affect magnetic properties.

The magnetic fluids of the present invention may be prepared by dissolving the surface-active agent and optionally, the antioxidant in the dicarboxylic diester solvent, adding a metal carbonyl to the medium, and heating the mixture to thereby thermally decompose the metal carbonyl. The metal carbonyl used herein may be pentacarbonyl iron as expressed by $Fe(CO)_5$ although not limited thereto. Thermal decomposition may be effected at a temperature of 140° to 280° C. for about 4 to 6 hours. The temperature and time may be suitably chosen in accordance with the concentration of iron.

The thus prepared magnetic fluid must be stored in a suitable sealed container. The interior of the container is preferably purged with an inert gas such as argon and nitrogen.

The magnetic fluid of the present invention has the advantages of improved dispersion and saturation magnetization over prior art magnetic fluids because metal fine particles of iron possessing increased saturation megnetization are dispersed in a dicarboxylic diester solvent or high-boiling solvent with the aid of a phospholipid surface-active agent.

Moreover, the use of a dicarboxylic acid diester solvent as the medium offers practical benefits in that the medium has improved properties including low volatility, thermal stability and lubricity.

Since iron is used as the metal fine particles to be dispersed, it is possible to produce magnetic fluid at a lower cost than cobalt fine particle dispersions.

The addition of the antioxidant retards oxidation of metal fine particles which is otherwise accompanied by saturation magnetization reduction.

EXAMPLES

In order that those skilled in the art will better understand how to practice the present invention, examples are given below by way of illustration and not by way of limitation.

EXAMPLE 1

Into a three-necked flask fitted with a reflux condenser, thermometer, and stirrer was admitted 4 grams of lecithin in 12 grams of dioctyl adipate. To this solution was added 8 grams of pentacarbonyl iron $Fe(CO)_5$.

With stirring, the mixed solution was gradually heated up to about 150° C. with the aid of a mantle heater. Heating under reflux caused the iron carbonyl to thermally decompose. The decomposition gas CO emitted from the top of the condenser. The emission of CO gas was confirmed by passing the gas into a $PdCl_2$ solution in 1/1 acetone/water. Introduction of CO gas turned the palladium chloride solution from orange to black. After CO emission subsided, stirring was continued for an additional 30 minutes. Upon cooling, there was obtained a black solution.

The black solution was centrifuged at 6,000 rpm for one hour. There was observed little separation or settlement. The fine particles in the solution were measured to have an average particle size of 70 Å.

Magnetic fluids of varying concentrations can be prepared by controlling the amount of medium. It will be understood that the concentration of a fluid is equivalently expressed by the specific gravity of the fluid. A number of magnetic fluids were prepared in the same manner as above and measured for specific gravity and saturation magnetization (4πMs/G). The results are shown in Table 1 and FIG. 1. The diagram of FIG. 1 shows the saturation magnetization as a function of the specific gravity of magnetic fluids.

TABLE I

| Fe-Lecithin-Dioctyl adipate System | | |
|---|---|---|
| Sample No. | Specific gravity | 4πMs/G (15 kOe) |
| 1 | 1.0495 | 14.5 |
| 2 | 1.1099 | 86.6 |
| 3 | 1.2198 | 128 |
| 4 | 1.3612 | 414 |
| 5 | 1.4890 | 663 |

EXAMPLE 2

The procedure of Example 1 was repeated except that the dioctyl adipate meadium was replaced by dioctyl sebacate. The resulting black solution was centrifuged at 6,000 rpm for ten hour to find little separation or settlement.

The fluid had a specific gravity of 1.4251 and a saturation magnetization of 500 G.

EXAMPLE 3

The procedure of Example 1 was repeated except that the dioctyl adipate medium was replaced by di(2-ethylhexyl) azelate. The resulting black solution was centrifuged at 6,000 rpm for one hour to find little separation or settlement.

The fluid had a specific gravity of 1.3612 and a saturation magnetization of 312 G.

EXAMPLE 4

To the fluid of Sample No. 5 in Example 1 having a specific gravity of 1.4890 and a saturation magnetization of 663 G, was added D,L-α-tocopherol antioxidant in an amount of 2.0% based on the weight of iron particles. The antioxidant-free fluid (Sample No. 5) and the antioxidant-containing fluid of this example were aged upon exposure to atmosphere to examine how their saturation magnetization varied with the lapse of time. The aging variation is expressed by the ratio of the saturation magnetization Ms(ex) at a point of measurement to the initial saturation magnetization Ms(in) of freshly prepared magnetic fluid (t=0). The results are shown in FIG. 2.

Figure 2:
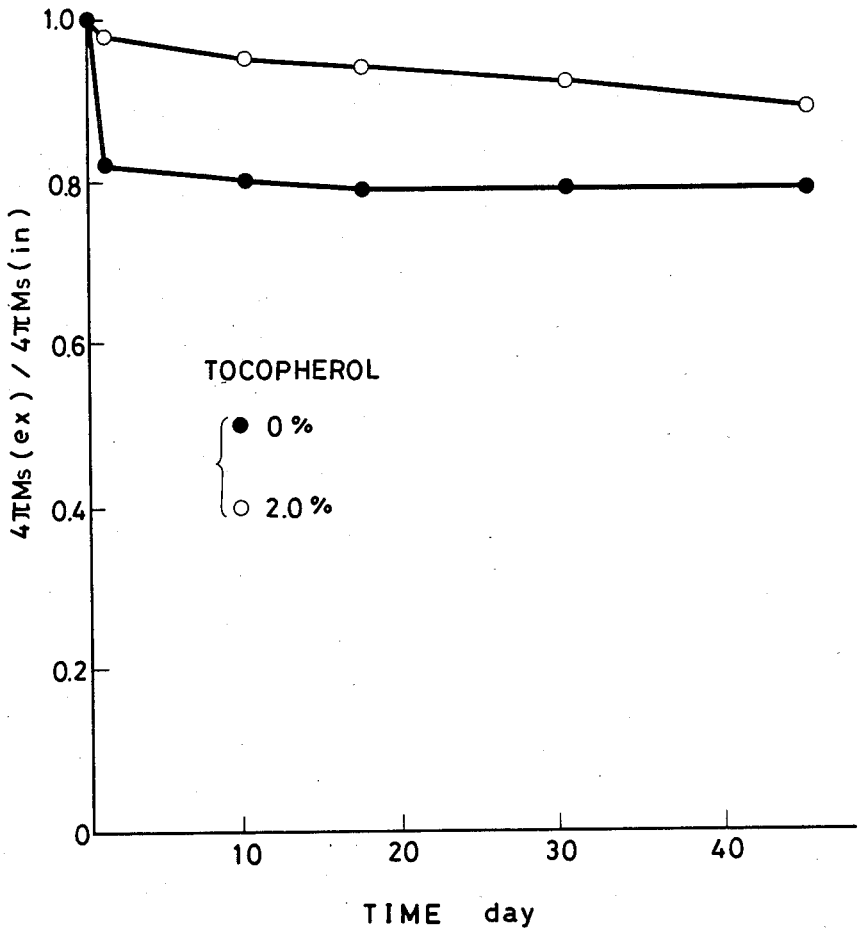
FIG. 2 is a diagram showing the variation with time of the saturation magnetization of antioxidant-containing and antioxidant-free magnetic fluids.

As seen from FIG. 2, the addition of D,L-α-tocopherol in an amount of 2.0% based on the weight of iron particles prevents the reduction of saturation magnetization at the end of about 40 days as compared with the antioxidant-free fluid.

These data show the unexpected effect of the present invention. That is, the present invention has succeeded in developing stable magnetic fluids possessing saturation magnetization as high as 300 to 700 G. Saturation magnetization is in direct proportion to metal particle concentration over a considerably wide concentration range. It is then possible to prepare a magnetic fluid possessing any desired saturation magnetization by properly changing the concentration of metal fine particles.

What is claimed is:

1. A magnetic fluid comprising metal fine particles of iron, a phospholipid surface-active agent, and a medium, the improvement wherein said medium is at least one member selected from the group consisting of diesters of dicarboxylic acids.

2. A magnetic fluid according to claim 1 wherein the metal fine particles have an average particle size of 70 to 100 Å.

3. A magnetic fluid according to claim 1 wherein the dicarboxylic diester is a diester of a saturated aliphatic dicarboxylic acid having 6 to 10 carbon atoms.

4. A magnetic fluid according to claim 1 wherein the dicarboxylic diester is an ester of a dicarboxylic acid with an aliphatic alcohol having 1 to 10 carbon atoms.

5. A magnetic fluid according to claim 3 wherein the dicarboxylic diester is an ester of a dicarboxylic acid with an aliphatic alcohol having 1 to 10 carbon atoms.

6. A magnetic fluid according to claim 1 wherein the dicarboxylic diester medium is present in an amount of 100 to 800% by weight of the weight of the metal fine particles.

7. A magnetic fluid according to claim 1 wherein the phospholipid is lecithin.

8. A magnetic fluid according to claim 1 wherein the surface-active agent is present in an amount of 50 to 100% of the metal fine particles on a weight basis.

9. A magnetic fluid comprising metal fine particles of iron, a surface-active agent, an effective amount of an antioxidant, and a medium wherein said medium is at least one member selected from the group consisting of diesters of dicarboxylic acids.

10. A magnetic fluid according to claim 9 wherein the antioxidant is tocopherol.

11. A magnetic fluid according to claim 9 wherein the antioxidant is present in an amount of 0.8 to 10% of the metal fine particles on a weight basis.

* * * * *